US006146239A

United States Patent [19]

Magliocchetti

[11] Patent Number: 6,146,239

[45] Date of Patent: Nov. 14, 2000

[54] BRASSIERE WITH SHIRT SLEEVE RETAINING LOOP

[76] Inventor: Jennifer Magliocchetti, 10203 Woodvale Pond Dr., Fairfax Station, Va. 22039

[21] Appl. No.: 09/433,938

[22] Filed: Nov. 4, 1999

[51] Int. Cl.[7] ..... A41C 3/00

[52] U.S. Cl. ..... 450/1; 450/86; 450/88; 450/81

[58] Field of Search ..... 450/1, 86, 81, 450/88; 2/269, 69, 338, 75, 80, 74, 115, 105, 106, 104, 113, 114, 125, 170, 270, 271, 912, 920, 232; 223/1; 24/707.05

[56] References Cited

U.S. PATENT DOCUMENTS

| | | | |
|---|---|---|---|
| D. 381,188 | 7/1997 | Allen . | |
| 798,943 | 9/1905 | Benjamin . | |
| 1,510,388 | 9/1924 | Darling | 450/1 |
| 2,264,972 | 12/1941 | Greenberg | 450/86 |
| 2,364,422 | 12/1944 | Brooks . | |
| 2,634,422 | 4/1953 | Cantrell . | |
| 3,086,529 | 4/1963 | Munz et al. | 2/338 |
| 4,289,137 | 9/1981 | Dell et al. . | |
| 4,384,583 | 5/1983 | Speelman et al. | 2/338 |
| 4,475,252 | 10/1984 | Peyser et al. . | |
| 4,583,544 | 4/1986 | Flanagan et al. . | |
| 4,816,005 | 3/1989 | Braetan . | |
| 4,917,651 | 4/1990 | Rainville . | |
| 5,033,986 | 7/1991 | Feigenbaum et al. . | |
| 5,172,428 | 12/1992 | Leinoff | 2/338 |
| 5,293,646 | 3/1994 | Winston . | |
| 5,692,239 | 12/1997 | Lewis . | |
| 5,787,511 | 8/1998 | Garside | 2/269 |
| 5,820,445 | 10/1998 | Smith et al. . | |
| 5,823,851 | 10/1998 | Dicker . | |

OTHER PUBLICATIONS

New Sleeve Scrunchies—All Sports Accessories Available In: Basketball, Softball, Volleyball and Soccer (Advertising page) No Date/No Source/Inventor.

Sleeve Scrunchies Only $4.99 pair—Just Chicks®—No Guys Allowed! http://www.justchicks.com/sleeve1.htm, May 27, 1999 No Inventor/Source Given.

*Primary Examiner*—Gloria M. Hale

*Attorney, Agent, or Firm*—Burns, Doane, Swecker & Mathis, L.L.P.

[57] ABSTRACT

To retain gathered sleeve material of a shirt at a shoulder position of the wearer, a sleeve material retaining loop is attached to or looped around a strap of a brassiere. One end of the material-retaining loop extends out of the neck hole of the outer garment, and another end of the sleeve material retaining loop extends out of the arm hole of the sleeve at a position located above the shoulder of the wearer. The first and second ends of the sleeve material retaining loop are then attached at the shoulder of the wearer to maintain the sleeve in a bunched condition. By this mechanism, the sleeves are removed from interfering with the arm movement of the wearer and a greater amount of skin area is exposed for evaporative cooling of the wearer.

10 Claims, 1 Drawing Sheet

BRASSIERE WITH SHIRT SLEEVE RETAINING LOOP

BACKGROUND OF THE INVENTION

1. Field of the Invention

The present invention relates to athletic clothing, and in particular, to a brassiere having a shirt retaining band or loop for selectively retaining a gathered shirt sleeve at the wearer's shoulder.

2. Discussion of Related Art

Sleeved garments such as tee-shirts, shirts, and blouses (hereinafter referred to collectively as "shirts") are common items of apparel. However, in some instances, the sleeves of such garments can interfere with the wearer's athletic activities and cause undue overheating. Shirt sleeves can interfere with the arm movement of the wearer and increase heat retention during athletic activities out-of-doors. For instance, U.S. Pat. No. 5,692,239 to Donald Lewis discloses a sleeve holder in the form of an epaulet with a hook and loop (VELCRO™) on a loose end thereof. The hook and loop fastener is attachable to either the shoulder, or to a matching fastener lower on the sleeve. By pulling up the sleeve and attaching the epaulet to the lower fastener, the sleeve can be retained in a drawn-up position. See, also U.S. Pat. No. 4,475,252 to Peyser. However, these mechanisms are suitable only for shirts on which epaulets are appropriate, and not athletic wear suitable for aerobic activity.

Also, by covering more skin surface, particularly the underarms, shirt sleeves can unduly cause the overheating of the athlete. Women tend to suffer more from this problem insofar as brassieres, or bras, particularly sports bras such as disclosed in U.S. Pat. No. 4,583,544 to Cherrie Flanagan et al., are commonly worn. The additional material of the bra adds to the wearer's heat retention.

These problems are particularly apparent in organized sports such as collegiate soccer and lacrosse, where the participants are required to wear sleeved outer garments to distinguish team members and for puritan sensibilities. Heretofore, female athletes would gather up the short sleeves of their outer athletic wear which proved irritating insofar as the sleeves would tend to slip down the athlete's arms and have to be re-gathered.

SUMMARY OF THE INVENTION

This irritating and longstanding problem is solved by the present invention, which provides a convenient mechanism for selectively retaining shirt sleeves in the gathered position at the wearer's shoulder. The present invention solves the foregoing problems of the prior art by providing a mechanism whereby sleeves gathered up can be retained in place by a loop of material, at least one end of which contains a fastener for connecting each end of a strap of material to form a loop. The looped material is fastened together as a loop encircling the material between the neck hole and end of the sleeve of the outer garment. The loop of material is preferably attached to a shoulder strap of a brassiere.

Several embodiments of the invention are shown which include various fastening means of the ends of the looped material, various mechanisms for attaching the loop of material to the bra, and methods of employing same.

BRIEF DESCRIPTION OF THE DRAWINGS

The present invention will now be described by way of exemplary embodiments, to which it is not limited, as illustrated in the accompanying drawings in which.

DETAILED DESCRIPTION OF THE INVENTION

Figure 1:
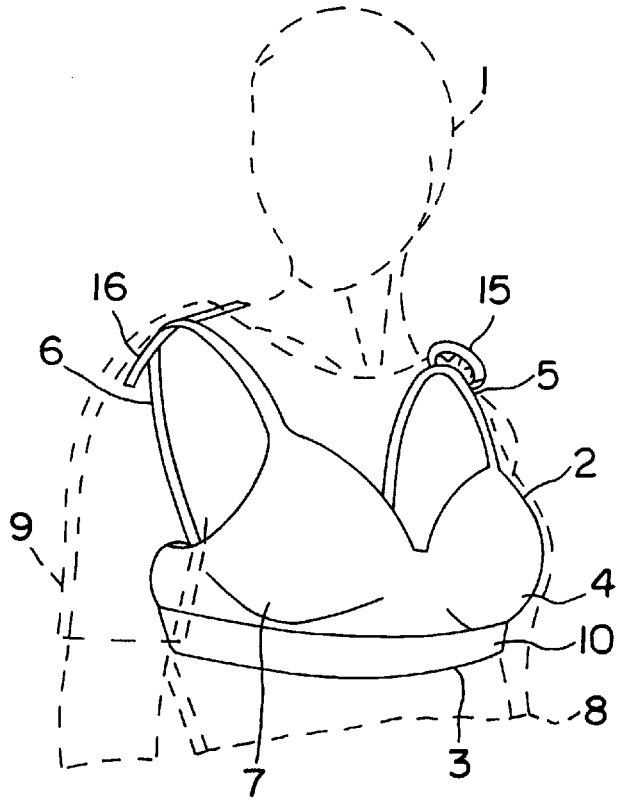
FIG. 1 is a view showing a brassiere with sleeve retaining loops in accordance with the present invention.

Referring to FIG. 1, a wearer 1 of a brassiere 2 incorporating the invention includes continuous, uninterrupted front panel 3 including first and second breast retaining portions 4 and 7. Attached to the first and second breast retaining portions 4 and 7 are first and second straps 5 and 6 which travel over the shoulder of the wearer to the rear panel (not shown) of the bra. An elastic band 10 continues around the torso of the wearer and is attached to the bottom edges of the front panel 3 and the rear panel (not shown).

The particular construction of the bra is preferred but not essential to the invention. The invention can be embodied in brassieres having bra cups, underbra support wires, or nearly any other type of undergarment having shoulder straps.

A shirt 8 (shown in phantom) has sleeves 9. The left sleeve 9 is illustrated in an extended position, extending down the wearer's arm. The right sleeve 9 is illustrated in a gathered state at the top of the wearer's shoulder.

The present invention is embodied by first and second elongated loops of material 15 and 16 which are attached to or looped around the first and second shoulder straps 5 and 6. An axis of the first and second loops of material 15 and 16 is attached to the bra straps 5 and 6, respectively, such that the axis of the loops is non-parallel to the axis of the shoulder strap, and is preferably at generally perpendicular thereto within a range of movement permitted by the bra 2 and the shirt 8.

The first and second loops of material 15 and 16 include a first end and a second end. At least one of the first and second ends has a garment fastener which fastens the first end to the second end. The first and second loops of material 15 and 16 have a sufficient length to loop around the material existing between the neck hole and the arm hole at the end of the sleeve 9 of the outer garment or shirt 8 worn by the wearer on top of the brassiere 2. In this way, the sleeves 9 are gathered and bunched at the shoulders of the wearer 1, comfortably out of the wearer's way, to expose more surface area of the wearer's skin, particularly around the underarms, to permit greater heat exchange.

As illustrated, two sleeve retaining loops 15 and 16 are provided, one for each sleeve. Naturally, if there is a particular need, only one loop may be supplied or used. Also, as explained in more detail below, the first and second sleeve retaining loops can be permanently fastened to the bra, or made detachable.

Figure 2A:
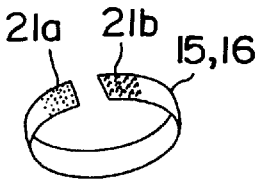
FIGS. 2(A)–2(C) show embodiments of invention including various examples of garment fasteners in the form of hook and loop fabric strips.
Figure 2B:
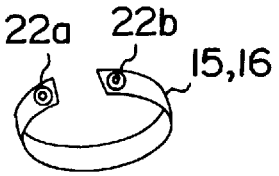
Figure 2C:
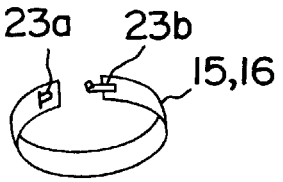

FIG. 2(A) shows a first embodiment of the sleeve retaining loops 15 and 16. As shown in FIG. 2(A), hook and loop fabric strips 21*a*, 21*b* are used at the first and second ends of the loop of material. Hook and loop fabric strips, commonly known by the trademark VELCRO™, are preferable insofar as the material is a relatively inexpensive garment fastener which can be used to adjust the overlap of the first and second ends to gather the shirt material tightly or loosely, and can accommodate various amounts of the shirt material.

Figure 3A:
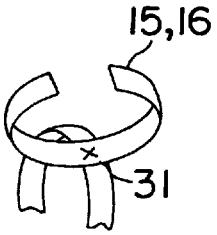
FIGS. 3(A)–3(C) show embodiments of the invention including various ways to secure the retaining loop to a bra strap.
Figure 3B:
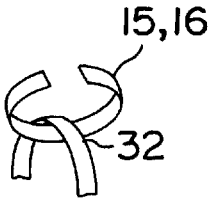
Figure 3C:
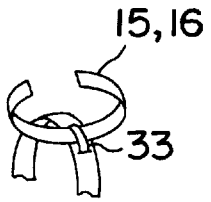

While the sleeve retaining loop material is preferably relatively soft, the hook and loop fastener material 21*a,* and 21*b* can be chafing. Accordingly, the loop 15 or 16 is preferably fastened to the bra in some convenient manner to prevent the loop end of the garment fastener from rotating against the wearer's skin. For instance, the sleeve retaining loop 15, 16 can be fastened to the bra 2 by an additional fastening means, such as sewing the loop to the top strap of the bra by stitching 31 as shown in FIG. 3(A), or underneath the bra. In addition to stitching 31, snaps (FIG. 3(B))), hook and loop fabric strips, and hooks and eyelets could be used. Additionally, the sleeve retaining loop 15, 16 can simply be placed underneath the bra strap 5, 6 without a fastener between the bra strap 5, 6 and the loop 15, 16, as shown in FIG. 3(B). The sleeve retaining loop 15, 16 can be used without attachment to the bra 2 or even under the bra strap 5, 6. However, these embodiments permit rotation of the sleeve retaining loop 15, 16 which can expose the skin to a chafing surface of the sleeve retaining loop 15, 16.

If one wishes to fasten the fastener of the sleeve retaining loop 15, 16 on top of the shirt, rotate it out-of-sight under the gathered sleeve material, and then fastening an additional strap loop 33 of material on top of or on the underside of the bra straps 5 and 6 will serve to secure the sleeve retaining loop 15, 16 and permit rotation of the sleeve retaining loop 15, 16 while minimizing chafing because the bra strap 5, 6 acts as a shield and guide to the sleeve retaining loop 15, 16.

The hook portion of the hook and loop fabric connectors 21*a,* 21*b* at the ends of the sleeve retaining loops 15, 16 should be on the surface of sleeve retaining loops 15, 16 away from the wearer's body, when in use. This will reduce chafing, even when the sleeve retaining loops 15, 16 are not engaged and the sleeves 9 are permitted to extend down the wearer's arm.

Modifications of the present invention include using various garment fasteners such as use of a button and a button hole with the button preferably on the upper surface of the bra strap on the surface of the sleeve retaining loop 15, 16 away from the wearer's body when not in use. Naturally, clasps, buckles and slip sleeves can be employed effectively.

In use, the wearer of a sleeved outer garment 8 simply gathers up a sleeve 9, grabs one end of a sleeve retaining loop 15, 16 found underneath the sleeve 9, and the other end of the loop 15, 16 through the neck opening of the outer garment 8, and fastens the two ends of the loop material 15, 16 together to retain the bunched-up sleeve material. This process is done either before or after the loop material is attached to the bra if attachment is desired.

Additionally, the sleeve retaining loop 15, 16 can simply be brought underneath the bra straps 5, 6 and no fastener employed as shown in FIG. 3(B). By attaching the sleeve retaining loops 15, 16 to the bra 2, the shirt material is gathered and retained at approximately the position of the bra strap 5, 6, which, in sports bras, is relatively fixed even when the athlete is energetically moving. This reduces chafing by the gathered shirt material. However, the loop can be used without attachment or being looped around a bra strap. Also, it is possible to simply tie two ends of a retaining loop together, rather than employ a fastener.

The present invention has been described by way of the foregoing embodiments. However, modifications and variations will occur to those skilled in the art without deviating from the spirit and scope of the present invention. For instance, while various garment fasteners have been described, doubtless other garment fasteners can be employed. Additionally, while the fabric of the sleeve retaining loops 15, 16 can be nylon, cotton, polyester, spandex or any fabric or blends thereof suitable for garment construction, doubtless other materials could be employed such as plastics or other non-woven materials. While the present invention has been principally described as being useful for athletic wear such as tee-shirts, it will be appreciated that the invention is useful for garments used for other purposes such as gardening and the like. The scope of the invention should be determined the claims appended hereto and equivalents thereof.

What is claimed is:

1. A brassiere, comprising:

a front panel including first and second breast retaining portions;

a rear panel attached to said front panel at first and second side portions defining an aperture through which a torso of a wearer may be present;

a first shoulder strap connecting said first breast retaining portions with said rear panel and defining an aperture through which an arm of a wearer may pass;

a second shoulder strap connecting said second breast retaining portion with said rear panel and defining an aperture through which another arm of a wearer may pass, wherein said first and second shoulder straps, said front panel and said rear panel define an aperture through which a head of a wearer may pass; and a first elongated strap of material associated with said first shoulder strap, wherein an axis of said first strap is non-parallel to an axis of said first shoulder strap, wherein said first strap includes a first end and a second end, at least one of said first and second ends having a first garment fastener which fastens said first and second ends together, and wherein said first strap has a length sufficient to loop around material of a shirt existing between a neck hole and an end of a sleeve of said shirt gathered when worn by the wearer on top of said brassiere.

2. A brassiere according to claim 1, further including an elastic understrap extending around the entire torso of the wearer.

3. A brassiere according to claim 1, further comprising a second elongated strap of material associated with said second shoulder strap, wherein an axis of said second strap is non-parallel to an axis of said second shoulder strap, wherein said second strap includes a first end and a second end, at least one of said first and second ends having a garment fastener which fastens said first and second ends together, and wherein said first strap has a length sufficient to loop around a material existing between a neck hole and an end of the sleeve of garment worn by the wearer on top of the brassiere.

4. A brassiere in accordance with claim 1, wherein said first elongated strap of material includes a second garment fastener for attaching said first elongated strap to said first shoulder strap.

5. A brassiere in accordance with claim 4, wherein said second garment fastener is selected from the group consisting of stitching, hook and loop fabric strips, a loop of material attached to said first shoulder strap, snaps, button holes, wire hooks and loops, and clasps.

6. A brassiere in accordance with claim 1, wherein said first garment fastener is selected from the group consisting of hook and loop fabric strips, snaps, buttons and button holes, slip sleeves, clasps, wire hooks and loops, and buckles.

7. A shirt sleeve retaining strap comprising a first end and a second end, at least one of said first and second ends having a first garment fastener which fastens said first and second ends together, a middle section large enough to extend around gathered material of a shirt existing between a neck hole and an end of a sleeve of said shirt; and a second garment fastener for attaching said shirt sleeve retaining strap to a brassiere strap.

8. A shirt sleeve retaining strap in accordance with claim 7, wherein said second garment fastener is selected from the group consisting of stitching, hook and loop fabric strips, a loop of material attached to said first shoulder strap, snaps, button holes, wire hooks and loops, and clasps.

9. A method of retaining a shirt sleeve comprising the steps of:

wearing a brassiere having shoulder straps;

attaching a sleeve retaining strap to at least one of said shoulder straps;

wearing a shirt having sleeves over said brassiere;

gathering up sleeve material of said shirt;

gathering up a first end of said sleeve retaining strap at the neck hole of the shirt;

gathering up a second end of said sleeve retaining strap at a sleeve opening of said shirt; and attaching said first end and said second end of said sleeve retaining strap such that said sleeve retaining strap holds said gathered up sleeve material of said shirt.

10. A brassiere according to claim 1, wherein the brassiere is a sports bra.

* * * * *